US011852006B2

(12) United States Patent
Fouda et al.

(10) Patent No.: US 11,852,006 B2
(45) Date of Patent: Dec. 26, 2023

(54) DOWNHOLE TUBULAR INSPECTION USING PARTIAL-SATURATION EDDY CURRENTS

(71) Applicant: Halliburton Energy Services, Inc., Houston, TX (US)

(72) Inventors: Ahmed Elsayed Fouda, Spring, TX (US); Junwen Dai, The Woodlands, TX (US); Freeman Lee Hill, III, Spring, TX (US); Christopher Michael Jones, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 17 days.

(21) Appl. No.: 17/665,182

(22) Filed: Feb. 4, 2022

(65) Prior Publication Data

US 2022/0389807 A1 Dec. 8, 2022

Related U.S. Application Data

(60) Provisional application No. 63/208,046, filed on Jun. 8, 2021.

(51) Int. Cl.
*E21B 47/002* (2012.01)
*E21B 47/085* (2012.01)
*E21B 47/0228* (2012.01)

(52) U.S. Cl.
CPC ..... *E21B 47/0025* (2020.05); *E21B 47/0228* (2020.05); *E21B 47/085* (2020.05)

(58) Field of Classification Search
None
See application file for complete search history.

(56) References Cited

U.S. PATENT DOCUMENTS

| | | | | |
|---|---|---|---|---|
| 3,940,689 | A * | 2/1976 | Johnson, Jr. | E21B 47/092 324/221 |
| 9,030,196 | B2 | 5/2015 | Boenisch | |
| 10,031,107 | B2 | 7/2018 | Boenisch | |
| 10,961,841 | B2 | 3/2021 | Amineh et al. | |
| 2004/0100256 | A1 * | 5/2004 | Fickert | G01N 27/902 324/238 |
| 2009/0242200 | A1 | 10/2009 | Badoux et al. | |
| 2016/0169794 | A1 | 6/2016 | Powers et al. | |
| 2016/0266269 | A1 | 9/2016 | Wilson et al. | |
| 2016/0349405 | A1 | 12/2016 | San Martin et al. | |
| 2017/0075023 | A1 | 3/2017 | Fouda et al. | |
| 2017/0082770 | A1 | 3/2017 | Mandviwala et al. | |
| 2017/0123096 | A1 | 5/2017 | Wilson et al. | |

(Continued)

OTHER PUBLICATIONS

International Search Report and Written Opinion for Application No. PCT/US2022/016750, dated May 23, 2022.

(Continued)

*Primary Examiner* — Douglas X Rodriguez
(74) *Attorney, Agent, or Firm* — John Wustenberg; C. Tumey Law Group PLLC

(57) ABSTRACT

A system for inspecting a tubular may comprise an electromagnetic (EM) logging tool and information handling system. The EM logging tool may further include a mandrel, one or more sensor pads attached to the mandrel by one or more extendable arms, and one or more partial saturation eddy current sensors disposed on each of the one or more sensor pads.

20 Claims, 4 Drawing Sheets

(56) References Cited

U.S. PATENT DOCUMENTS

| | | | |
|---|---|---|---|
| 2017/0139073 | A1 | 5/2017 | Gorek et al. |
| 2017/0248728 | A1 | 8/2017 | Fouda et al. |
| 2017/0248730 | A1 | 8/2017 | San Martin et al. |
| 2017/0254917 | A1 | 9/2017 | Fouda et al. |
| 2017/0269253 | A1 | 9/2017 | Fouda et al. |
| 2017/0275985 | A1 | 9/2017 | Fouda et al. |
| 2018/0003850 | A1 | 1/2018 | Jaaskelainen et al. |
| 2018/0066509 | A1 | 3/2018 | Fouda et al. |
| 2018/0106763 | A1 | 4/2018 | Fouda et al. |
| 2018/0106764 | A1 | 4/2018 | Fouda et al. |
| 2018/0135405 | A1 | 5/2018 | Fouda et al. |
| 2018/0143344 | A1 | 5/2018 | Dai et al. |
| 2018/0172872 | A1 | 6/2018 | Fouda et al. |
| 2018/0209265 | A1 | 7/2018 | Fouda et al. |
| 2018/0223648 | A1 | 8/2018 | Wilson et al. |
| 2018/0347353 | A1 | 12/2018 | Wang et al. |
| 2019/0003815 | A1 | 1/2019 | San Martin et al. |
| 2019/0063213 | A1 | 2/2019 | Donderici et al. |
| 2019/0078430 | A1 | 3/2019 | Fouda et al. |
| 2019/0196039 | A1 | 6/2019 | Wilson et al. |
| 2019/0218904 | A1 | 7/2019 | Fouda et al. |
| 2019/0277995 | A1 | 9/2019 | Fouda et al. |
| 2019/0339230 | A1 | 11/2019 | Khalaj Amineh et al. |
| 2019/0369285 | A1 | 12/2019 | Fouda et al. |
| 2019/0383135 | A1 | 12/2019 | Hill, III |
| 2019/0390544 | A1 | 12/2019 | Dai et al. |
| 2020/0003929 | A1 | 1/2020 | Wilson et al. |
| 2020/0081148 | A1* | 3/2020 | Capoglu ..... E21B 47/024 |
| 2020/0103374 | A1 | 4/2020 | Guner et al. |
| 2020/0109974 | A1 | 4/2020 | Hill, III et al. |
| 2020/0182830 | A1 | 6/2020 | Fouda et al. |
| 2020/0190969 | A1 | 6/2020 | Ren et al. |
| 2020/0200940 | A1 | 6/2020 | Fouda et al. |
| 2020/0209425 | A1 | 7/2020 | Ewe et al. |
| 2020/0217982 | A1 | 7/2020 | San Martin et al. |
| 2020/0257014 | A1* | 8/2020 | Khalaj Amineh .... E21B 47/092 |
| 2020/0271817 | A1 | 8/2020 | Ewe et al. |
| 2020/0271818 | A1 | 8/2020 | Fouda et al. |
| 2020/0284141 | A1 | 9/2020 | San Martin et al. |
| 2020/0309986 | A1 | 10/2020 | Donderici et al. |
| 2020/0319362 | A1 | 10/2020 | Guner et al. |
| 2020/0333500 | A1 | 10/2020 | Fouda et al. |
| 2020/0378240 | A1 | 12/2020 | Fouda et al. |
| 2021/0054731 | A1 | 2/2021 | Fouda et al. |
| 2021/0080610 | A1 | 3/2021 | Fouda et al. |
| 2021/0088686 | A1 | 3/2021 | Samson et al. |
| 2021/0198998 | A1 | 7/2021 | Donderici et al. |
| 2021/0208103 | A1 | 7/2021 | Hill, III et al. |
| 2021/0108507 | A1 | 8/2021 | Hill, III et al. |
| 2021/0239874 | A1 | 8/2021 | Fouda |
| 2021/0256671 | A1 | 8/2021 | Guner et al. |
| 2021/0304386 | A1 | 9/2021 | Guner et al. |
| 2021/0355812 | A1 | 11/2021 | Fouda et al. |

OTHER PUBLICATIONS

Schlumberger, EM Pipe Scanner, Electromagnetic Casing Inspection Tool, 2009.

GoWell, MTD, 2022. Accessed Jan. 2022, Available at https://www.gowellpetro.com/well-integrity-analysis.

TGT, Pulse, Accessed Jan. 2022, Available at https://tgtdiagnostics.com/systems/tgt-pulse-1/.

* cited by examiner

DOWNHOLE TUBULAR INSPECTION USING PARTIAL-SATURATION EDDY CURRENTS

CROSS-REFERENCE TO RELATED APPLICATIONS

The present application is a non-provisional of U.S. Patent Application No. 63/208,046, filed on Jun. 8, 2021, the entire disclosure of which is incorporated herein by reference.

BACKGROUND

A variety of tubular equipment is used in constructing and operating hydrocarbon recovery wells. A well is typically drilled with a rotary drill bit, giving the wellbore a generally circular profile. The well may then be completed for production using various tubular members (i.e., tubulars). Long strings of tubulars, known as tubing strings or tubular strings, may be constructed by coupling individual tubing segments end to end. For example, portions of the wellbore may be reinforced with a tubular metallic casing. Multiple sections of casing may also be installed of progressively narrower diameter. Liners and production tubing are other types of tubular metallic equipment installed downhole.

Many types of tubulars used in well construction remain downhole for the life of the well. Proactive surveillance of downhole tubulars is therefore important to ensure equipment availability, uninterrupted operation, reduced maintenance cost, and minimal nonproductive time. Early detection of metal loss is of great importance to oil and gas wells management. Failure to detect tubular flaws, such as cracks, pitting, holes, and any metal loss due to corrosion, may require expensive remedial actions and shut down of production wells. A number of tool types have therefore been developed for inspection of downhole tubulars.

Various inspection tools have been developed for inspecting tubulars. Some tools, like mechanical calipers and video-imaging tools, can only examine the inner surface of the first (innermost) tubing string. Ultrasonic tools can inspect both inner and outer surfaces for the first string. However, any dirt or debris may show up as anomalous features or artifacts in the data. This means that ultrasonic inspection may not be used for some wellbore environments where tubulars cannot be cleaned, for example those with a small inner diameter. Magnetic flux leakage tools can also inspect both inner and outer surfaces of the first string. However, magnetic flux leakage tools need to magnetize the test component to a very high level, which is not achievable for certain types of tubulars made of non-ferromagnetic materials. Finally, remote field eddy current (RFEC) tools use low-frequency signals to detect anomalies on multiple nested tubulars, not just the first string. However, the low-frequency signals of RFEC sensors provides relatively low vertical resolution and no azimuthal discrimination.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
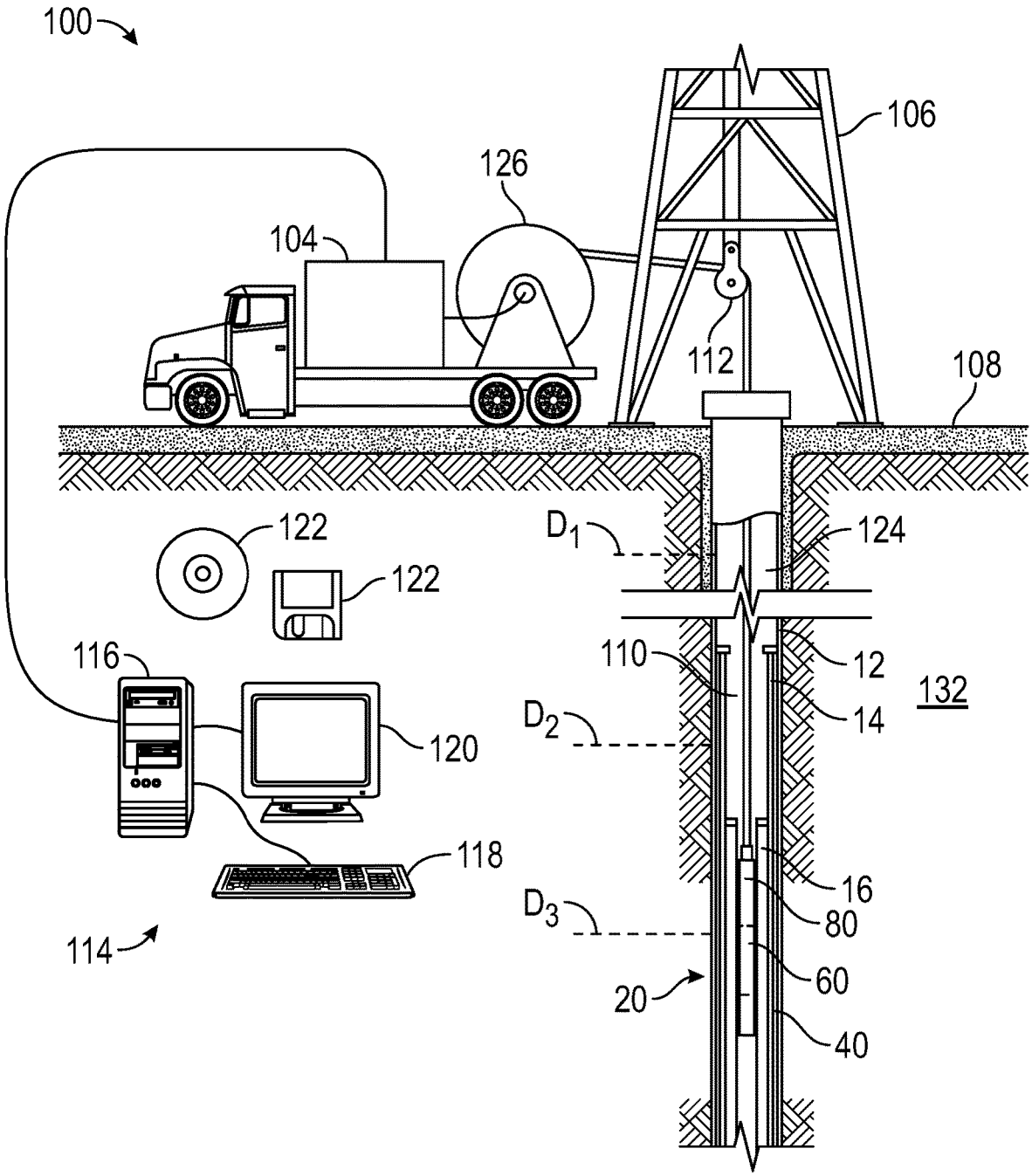
FIG. 1 is a schematic, elevation view of a downhole tubular inspection system implemented at an example well site.

Tools and methods are disclosed for inspecting downhole tubulars using partial-saturation eddy current (PSEC) sensors and principles. Ferromagnetic tubulars have high relative permeability, so the penetration depth of eddy currents induced by an electromagnetic wave on the order of one kilohertz may conventionally be limited to a few tenths of a millimeter. At this depth, anomalies on the outer pipe surface cannot ordinarily be detected. As taught herein, the penetration depth of the eddy current is increased using the effect of partial saturation eddy currents. This method is well suited to detect pitting corrosion and local defects in tubes made from ferromagnetic material. The PSEC sensors provide higher-resolution capabilities than conventional remote field eddy current (RFEC) tools, and provide directional (e.g., azimuthal) discrimination.

The disclosed tools and methods are capable of selectively obtaining tubular parameters of an inspected downhole tubular. As used herein, the term "tubular parameters" includes parameters of the inspected tubular, including but not limited to a pipe thickness, a percentage metal loss or gain, a magnetic permeability, an electrical conductivity, an eccentricity, and an inner diameter (ID) or outer diameter (OD). The term "electromagnetic material properties" as used herein comprises a subset of tubular parameters that relate to electromagnetivity, including but not limited to magnetic permeability and electrical conductivity.

In one or more examples, an inspection tool is lowered through a ferromagnetic downhole tubular. A constant magnetic field is generated by a coil or a permanent magnet to reduce the permeability of the downhole tubular, thereby increasing the penetration depth of an induced eddy current. The PSEC sensors are responsive to changes in the eddy current corresponding to a tubing wall variation of the downhole tubular. If the cross section of the tubing wall is reduced by a defect, for example, compression of the field lines occurs, thus increasing the field strength in this area. This local increase of the field strength can be detected by the PSEC sensors, as the signal amplitude is related to the defect volume. By increasing the penetration depth, it is now possible to inspect the full wall thickness of the downhole tubular.

An example tool and method may comprise one or more PSEC-based sensor modules with a magnetizer unit and PSEC sensors arranged on sensor pads. The magnetizer unit generates a constant magnetic field to reduce permeability of the inspected downhole tubular, while the PSEC sensors induce an eddy current and detect changes in the induced eddy current. The sensor pads may be coupled to the tool body using extendable arms to adjust a standoff distance from the inner diameter (ID) of the inner tubular. The extendable arms and sensor pads may be circumferentially spaced for a range of azimuthal positions. The extendable arms and sensor pads may also be arranged in at least two axial stations to position the PSEC sensors at different azimuthal and axial positions to achieve fuller azimuthal coverage. The extendable arms may also be arranged in pairs, with a first arm extending upwardly from each sensor pad and a second arm extending downwardly from the sensor pad to facilitate uplog and downlog. The tool may be centered with non-ferromagnetic tool centralizers to minimize sensor interference.

Proximity sensors may also be included with the tool to obtain a standoff (radial distance) from the tubular wall. The standoff measurements may be used to facilitate logging, such as to dynamically adjust the extension of the arms for uniform standoff and/or to compensate PSEC measurements. The use of proximity sensors to control arm extension may also be used to enhance the tubular inspection, such as to estimate one of the ovality, bending or buckling. In cases wherein a first downhole tubular is nested in a second downhole tubular, a baseline of sensor measurements may be obtained from the first downhole tubular and used to estimate an eccentricity of the first downhole tubular with respect to the second downhole tubular.

A number of useful actions may be performed based on the sensor data obtained from the PSEC sensors, alone or together with measurements from other sensors such as directional sensors and proximity sensors. For example, the tool may display real-time images representative of the inspected tubular and its variation with depth. The visual representation may include anomalies, such as cracks, pitting, holes, and corrosion in the tubing wall detected by the PSEC sensors. The PSEC measurement data may be combined with other data, such as directional data, and analyzed together to provide a more comprehensive analysis. The visual representation may also include deviations from a circular cross-section or straight-tubing assumption, such as eccentricity, ovality, bending, or buckling, obtained using directional and proximity sensors. The sensor data may also be used in real-time to adjust logging parameters such as logging speed, repeat runs, and a power level of the tool, responsive to detected anomalies in the tubing wall. These any many other features are discussed below with respect to example embodiments.

FIG. 1 is a schematic, elevation view of a downhole tubular inspection system 100 implemented at an example well site 10. While FIG. 1 generally depicts a land-based well site 10, those skilled in the art will recognize that the principles described herein are equally applicable to other well sites, such as offshore operations that employ floating or sea-based platforms and rigs, without departing from the scope of the disclosure. The well site 10, system 100, and their various components are conceptually and schematically depicted in FIG. 1 and are generally not to scale. A wellbore 124 extends from a surface 108 of the well site 10 down to a hydrocarbon-bearing formation 132. For ease of illustration, the wellbore 124 is shown extending vertically. However, the wellbore 124 may follow any given wellbore path through the formation 132, particularly with the use of directional drilling techniques, and may therefore include horizontal and/or deviated sections (not shown).

The system 100 includes a downhole tubular inspection tool 20 lowered into a wellbore 124 on a conveyance 110. In this example, the conveyance 110 is depicted as a wireline delivered from a reel 126 of a wireline vehicle 104 and supported by a rig 106. However, the conveyance 110 may alternately be any suitable conveyance for conveying the tubular inspection tool 20 downhole, including, but not limited to, wireline, slickline, coiled tubing, pipe, drill pipe, drill string, or downhole tractor. In some examples, the downhole tubular inspection tool 20 can be run in memory on slickline operations, including but not limited to digital slickline. In some examples, the tool 20 comprises a memory unit to store the full resolution data. The conveyance 110 may provide mechanical suspension, electrical and/or optical connectivity for power and signal communication, and in some cases fluid communication, for the downhole tubular inspection tool 20.

The well may include any number of tubulars of any type for inspection by the disclosed tools and methods. FIG. 1 illustrates, by way of example, a first tubular 12, a second tubular 14, and a third tubular 16. The tubulars 12, 14, 16 may be any ferromagnetic tubulars for inspection. The first tubular 12 may be, for example, a casing string cemented in place to reinforce the wellbore 124. The second tubular 14 may be, for example, a conductor casing disposed interior to the casing 12 having an upper end disposed below the upper end of the casing 12. A third tubular 16 may be, for example, a production tubing string disposed interior to the second tubular 14, with an upper end below the upper end of the second tubular 14. The overlapping tubulars provide examples of nested tubular arrangements at different depths. At a depth D1, there is just the single tubular 12. At a depth D2, the first and second tubulars 12, 14 are axially overlapping, with the second tubular 14 being the innermost tubular at depth D2. At a depth D3, all three tubulars 12, 14, 16 are overlapping, with the third tubular 16 being the innermost tubular at depth D3.

The tool 20 may be moved through one or more of the tubulars 12, 14, 16 for inspection using a plurality of PSEC sensors and optional directional sensors. The tool 20 may be lowered through one or more of the tubulars (downlogging) and/or raised through one or more of the tubulars (uplogging). The downhole tubular inspection tool 20 may be optimized for inspecting the nearest tubular where the tubulars overlap, as in the example of FIG. 1. However, the downhole tubular inspection tool 20 may at least be capable of inspecting each of the three tubulars, sequentially, by gradually lowering the downhole tubular inspection tool 20 to first log the first tubular 12, lowering the tool 20 further to then log the second tubular 14, and lowering the tool 20 even further to then log the third tubular 16. Measurements of one downhole tubular may also be used as a baseline for assessing its relationship to another downhole tubular (e.g., eccentricity) where the two downhole tubulars overlap.

The downhole tubular inspection tool 20 may be organized functionally and/or spatially in multiple sensor sections having sensors of corresponding type. In examples discussed below, sensors will be mounted on extendible arms. In some examples, some sensors may alternatively be organized in one or more sensor bundle incorporated into a tool body. By way of example, FIG. 1 includes a first PSEC section 40 and second PSEC section 60 for obtaining PSEC sensor data regarding the downhole tubulars. A third, directional sensor section 80 may include directional sensors, such as a gyroscope or accelerometer for obtaining directional data (e.g., dip angle and azimuthal angle) in proximity to the downhole tubular inspection tool 20. The PSEC sections 40, 60 and directional sensor section 80 may be on separate tool bodies, and still be considered as part of the same tool for the purpose of this disclosure. Although the various sensor sections 40, 60, 80 may be spaced as closely as practicable, physical and/or electrical constraints might require these sections 40, 60, 80 to have at least some axial separation from each other. Although each section is at a different depth in the wellbore 124 at any given instant during measurements, the depth information associated with their respective measurements as a function of depth may be recorded so that measurements at a given depth may be compared or related.

The PSEC sections 40, 60 are capable of detecting internal and external defects based on changes in an induced eddy current corresponding to a tubing wall variation. The PSEC sections 40, 60 may operate at higher-frequency and the readings obtained are generally directional (azimuth) and higher-resolution than conventional eddy current sensors. In some embodiments, the PSEC sections 40, 60 may each operate in a frequency range of 10 kHz-150 kHz, for example. The PSEC sections 40, 60 estimate one or more parameters (i.e., tubular parameters) of the nearest tubular, which is the third tubular 16 in the example of FIG. 1 when the tool 20 is positioned at depth D3. These tubular parameters may include magnetic permeability, electrical conductivity, ID, and wall thickness at any given depth.

The directional sensor section 80 may include directional sensors such as gyroscope, accelerometer, and/or magnetometer capable of sensing relative direction/angle within the wellbore 14. For example, the directional sensors may comprise a triaxial gyroscope or accelerometer to measure tool dip (tilt) and azimuth (rotation) angles. The sensor data from the different sections, including PSEC inspection data from the first and/or second PSEC sections 40, 60, and the directional data from the directional sensor section 80, may be aggregated, correlated, compared, analyzed, or otherwise processed to give a more comprehensive assessment of the tubulars 12, 14, 16 beyond just the measurements of the individual sections.

Information from the downhole tubular inspection tool 20 including from the two PSEC sections 60 and directional sensor section 80 may be gathered and/or processed by information handling system 114. For example, signals recorded by downhole tubular inspection tool 20 may be stored on memory and then processed by downhole tubular inspection tool 20. The processing may be performed real-time during data acquisition or after recovery of downhole tubular inspection tool 20. Processing may alternatively occur downhole or may occur both downhole and at surface. In some examples, signals recorded by downhole tubular inspection tool 20 may be conducted to information handling system 114 by way of the conveyance 110. Information handling system 114 may process the signals, and the information contained therein may be displayed for an operator to observe and stored for future processing and reference. Information handling system 114 may also contain an apparatus for supplying control signals and power to downhole tubular inspection tool 20. The components of the information handling system 114 that participate in this control of the inspection tool 20 may be collectively referred to as the controller. The controller, accordingly, may include above-ground and/or below-ground components. In one example embodiment, the tool 20 is controlled using a surface logging unit, which displays images of the tubular walls in real-time on the display 120. The real-time images are used to adjust at least one logging parameter. Non-limiting examples of logging parameters include logging speed, repeat runs, and a power level of the tool 20.

Systems and methods of the present disclosure may be implemented, at least in part, with information handling system 114. While shown at surface 108, information handling system 114 may also be located at another location, such as remote from wellbore 124. Information handling system 114 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 114 may be a processing unit 116, a network storage device, or any other suitable device and may vary in size, shape, performance, functionality, and price. Information handling system 114 may include random access memory (RAM), one or more processing resources such as a central processing unit (CPU) or hardware or software control logic, ROM, and/or other types of nonvolatile memory. Additional components of the information handling system 114 may include one or more disk drives, one or more network ports for communication with external devices as well as an input device 118 (e.g., keyboard, mouse, etc.) and video display 120. Information handling system 114 may also include one or more buses operable to transmit communications between the various hardware components.

Alternatively, systems and methods of the present disclosure may be implemented, at least in part, with non-transitory computer-readable media 122. Non-transitory computer-readable media 122 may include any instrumentality or aggregation of instrumentalities that may retain data and/or instructions for a period of time. Non-transitory computer-readable media 122 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

The downhole tubular inspection tool 20 may be connected to and/or controlled by information handling system 114, which may include at least some above-ground components, i.e., at surface 108, and may include at least some below-ground components, such as in the inspection tool 20 or a tool string supported on the conveyance that includes the inspection tool 20. Without limitation, information handling system 114 may be disposed downhole in downhole tubular inspection tool 20. Processing of information recorded may occur downhole and/or on surface 108. In addition to, or in place of processing at surface 108, processing may occur downhole. Processing occurring downhole may be transmitted to surface 108 to be recorded, observed, and/or further analyzed. Additionally, information recorded on information handling system 114 that may be disposed downhole may be stored until downhole tubular inspection tool 20 may be brought to surface 108. In examples, information handling system 114 may communicate with downhole tubular inspection tool 20 through a fiber optic cable (not illustrated) disposed in (or on) the conveyance 110. In examples, wireless communication may be used to transmit information back and forth between information handling system 114 and downhole tubular inspection tool 20. Information handling system 114 may transmit information to downhole tubular inspection tool 20 and may receive as well as process information recorded by downhole tubular inspection tool 20. In examples, a downhole information handling system (not illustrated) may include, without limitation, a microprocessor or other suitable circuitry, for estimating, receiving and processing signals from downhole tubular inspection tool 20. Downhole information handling system (not illustrated) may further include additional components, such as memory, input/output devices, interfaces, and the like. In examples, while not illustrated, downhole tubular inspection tool 20 may include one or more additional components, such as analog-to-digital converter, filter and amplifier, among others, that may be used to process the measurements of downhole tubular inspection tool 20 before they may be transmitted to surface 108. Alternatively, raw measurements from downhole tubular inspection tool 20 may be transmitted to surface 108.

Any suitable technique may be used for transmitting signals from downhole tubular inspection tool 20 to surface 108. As illustrated, a communication link (which may be wired or wireless and may be disposed in the conveyance 110, for example) may be provided that may transmit data from downhole tubular inspection tool 20 to an information handling system 114 at surface 108.

Figure 2:
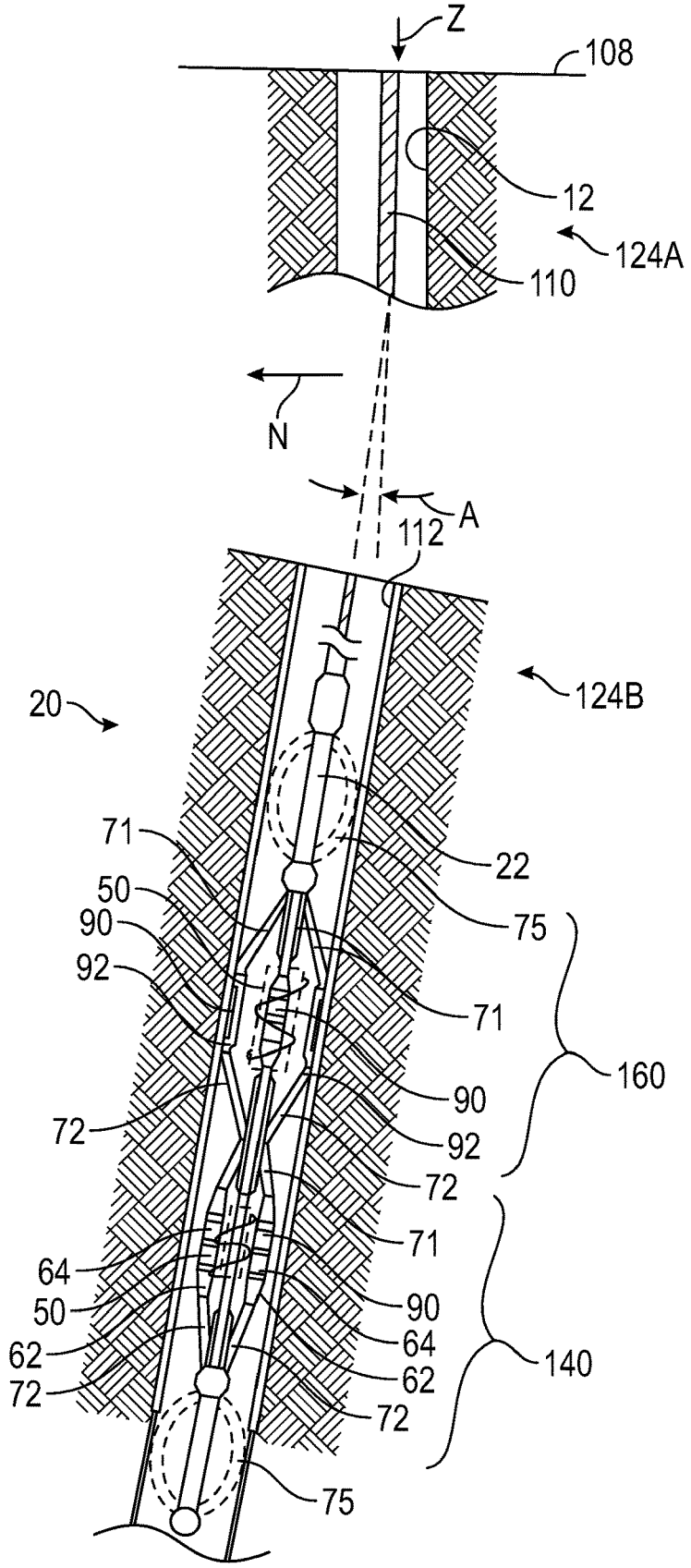
FIG. 2 is a side view of a downhole tubular inspection tool having axially-spaced lower and upper pad stations disposed in a downhole tubular to be inspected.

FIG. 2 is a side view of a downhole tubular inspection tool 20 having axially-spaced lower and upper pad stations 140, 160 disposed in a downhole tubular 112 (e.g., a casing) to be inspected. The tool 20 includes a tool body 22, which may comprise a mandrel, configured for connection to the conveyance (e.g., wireline). A PSEC sensor module includes a magnetizer unit 50 in combination with PSEC sensors 64 for inspecting a tubular wall thickness of the casing 12 or other tubular. The magnetizer unit 50, which may be located in the tool body or on pads, may comprise a coil or permanent magnet that generates a constant magnetic field to reduce a permeability of the downhole tubular 112 being inspected. The PSEC sensors 64 induce an eddy current and are responsive to changes in the induced eddy current corresponding to a tubing wall variation of the downhole tubular 112. One or more directional sensors (e.g., see FIG. 1) may be coupled to a tool body 22 to sense a directional orientation of the tool body as it is lowered through the first downhole tubular. The directional sensors (e.g., gyroscope, accelerometer, and/or magnetometer) may be coupled to the tool 20 above or below the pad stations 140, 160.

The lower and upper pad stations 140, 160 facilitate measurements and different azimuthal and axial locations. The lower pad station 140 may be an example configuration of the first PSEC sensor section 40 of FIG. 1 and the upper pad station 160 may be an example configuration of the second PSEC sensor section 60 of FIG. 1. Each pad station 140, 160 includes a plurality of sensor pads 62, 92 coupled to a tool body 22 on extendible arms 71, 72. Generally, a sensor pad according to this disclosure provides a mounting location for a sensor. A sensor pad may comprise a shape, structure, geometry, and/or materials that are beneficial as a mounting location for sensors. For example, a sensor pad may provide wear resistance and/or a structure that can withstand being lowered through long stretches of a wellbore, and which may help protect the sensors. A sensor pad may also position the sensors near an outermost location of the tool 20. Moreover, a sensor pad may be movably secured to a tool body so that a tool of any given tool diameter can cover a range of tubular sizes by adjusting the radial positioning of the sensor pads as described herein. In this example, the sensor pads include PSEC sensor pads 62 for mounting a plurality of PSEC sensors 64 and proximity sensor pads 92 for mounting optional proximity sensors 90 (e.g., ultrasound). The tool body 22 may be centralized or at least spaced from an internal diameter (ID) of the downhole tubular 112 with nonferromagnetic tubing centralizers 75 above and below the pad stations 140, 160.

The PSEC sensor pads 62 are coupled to the tool body 22 on extendible arms 71, 72. The proximity sensor pads 92 are also coupled to the tool body 22 on extendible arms 71, 72, although the proximity sensors 90 could alternatively be secured to fixed locations on the tool body 22. The extendible arms include one or more upper arm 71 (i.e., an uplogging arm) extending upwardly from the respective pad 62 or 92 to the tool body 22 to facilitate uplogging, and one or more lower arm 72 (i.e., a downlogging arm) extending downwardly from the respective pad 62 or 92 to the tool body 22 to facilitate downlogging. This mechanical arrangement allows the extendible arms to move inwardly and minimize the risk of being hung up whether the downhole tubular inspection tool 20 is being tripped uphole or downhole.

The PSEC sensor pads 62 are circumferentially spaced about the tool body 22 on the extendable arms 71, 72 to obtain measurements at different azimuthal locations. The PSEC sensors 64 in the upper axial station 160 are in different axial and azimuthal positions than the PSEC sensors 64 in the lower axial station 140, for full azimuthal coverage. The proximity sensor pads 92 are circumferentially arranged between the PSEC sensor pads 62. Thus, in the view of FIG. 2, the azimuthal positions of the PSEC sensors 64 in the upper pad station 160 are approximately ninety degrees from proximity sensors 90 in the upper pad station and approximately ninety degrees apart from the PSEC sensors 64 in the lower pad station 140.

The extendable arms 71, 72 are movable radially to achieve a desired standoff (radial distance) between the PSEC sensor pads 62 and the ID of the tubular being inspected. The proximity sensors 90 may be used to determine the standoff between the PSEC sensors 64 so a controller may adjust the extension of the arms. In the illustrated embodiment, the proximity sensor pads 92 are also secured to one or more of the extendible arms 71, 72 to move radially with the PSEC sensor pads 62. Thus, the standoff of the PSEC sensors 64 may be determined based on the variable position of the proximity sensors 90 to the tubular ID. Alternatively, the proximity sensors 90 could be secured to a fixed location on the tool body 22, so standoff of the PSEC sensors 64 may be determined based on the distance from the proximity sensors 90 to the tubular ID and the amount of extension of the arms 71, 72. A pad alignment algorithm may be applied to depth align features on images from different pad stations.

The ability to control the extension of the extendible arms 71, 72 may be used in a variety of ways. In one example, a controller may control the extension of the arms 71, 72 to maintain essentially equal standoff across all sensor pads 62, even in different tubular sizes. The PSEC measurements may also be compensated for different standoff distances from the pipes inner wall to derive the correct information. Images of the well tubing may be displayed in real-time, such as in the system 100 of FIG. 1, using the real-time image to adjust one or more logging parameter such as logging speed, repeat runs, and power level of the tool.

Directional sensors may also be incorporated into the tool body 22, such as the directional sensor section 80 of FIG. 1. FIG. 2 shows an example of a vertical wellbore section 124A extending from the surface 108 and a deviated section 124B in which the tool 20 is being lowered. A vertical wellbore section such as section 124A may be regarded as perpendicular to the earth's surface, aligned with the direction of gravity along a vertical axis (Z-axis in the illustrated reference frame). A vertical wellbore therefore has a zero angle and no azimuth about the vertical axis. A wellbore may include portions that deviate from vertical, such as the deviated section 124B, particularly where directional drilling is used. The deviated section 124B has a dip angle "A" relative to vertical axis and an azimuth about the vertical axis. The azimuth may be measured relative to a fixed reference frame, such as magnetic north "N." The directional sensors may be used alone or in combination while logging to obtain various directional data, such as a variation in the dip angle and azimuth with depth.

FIGS. 3-6 are an example sequence illustrating how PSEC and directional data, obtained with an inspection tool such as described in FIGS. 1-2, may be used to characterize the downhole tubular being inspected. These figures are primarily schematic and not to scale. Thus, certain features or imperfections may be exaggerated for ease of illustration.

Figure 3:
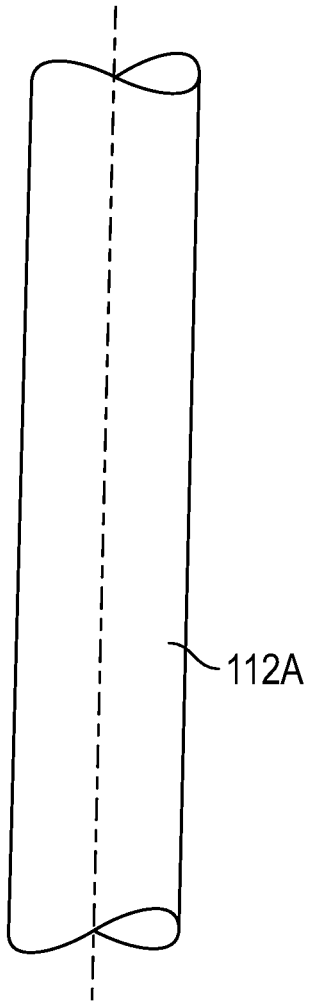
FIG. 3 is a schematic diagram representing a simplified tubing assumption.

FIG. 3 is a schematic diagram representing a simplified tubing assumption sometimes used in conventional tubing inspection and analysis. The simplified tubing assumption is that the downhole tubular 112 being inspected is perfectly straight and circular in cross-section. Sensor measurements based on this simplified tubing assumption may neglect to account for the possibility of bent, uneven, or eccentric tubing, for example, which can give an incomplete perspective on the condition of the downhole tubular and affect the accuracy of measurements or decisions based on measurements. Even if useful information about the inner surface of the tubing wall is obtained, the failure to diagnose or assess the non-linearity or other deviation from the simplified tubing assumption of the inspected tubular can limit the analysis.

Figure 4:
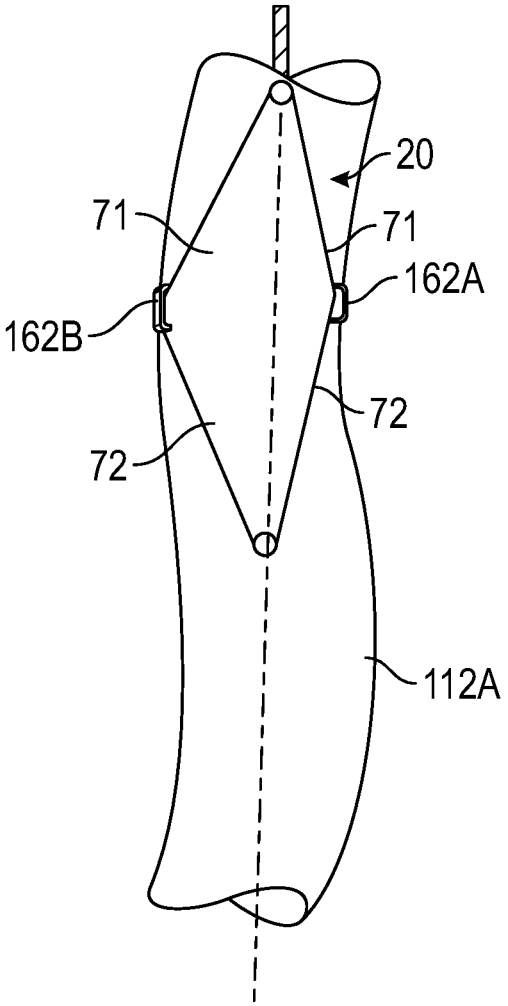
FIG. 4 is a schematic diagramming of obtaining a corrected tubing assumption using the disclosed downhole tubular inspection tool.

FIG. 4 is a schematic diagramming of obtaining a corrected tubing assumption using the disclosed downhole tubular inspection tool 20. The tubular 112A being inspected is non-linear (e.g., bent or otherwise undulating), rather than straight. The extension of pads on the arms may be used to measure one of the ovality, bending, or buckling of the tubular 112A, wherein the tubular 112A is an inner tubular. For example, as the inspection tool 20 is moved through the bent tubular 112, the extendible arms 71, 72 move so that the sensor pad 162A at one azimuthal location is at a different radial offset from the sensor pad 162B at another azimuthal location. The sensor pads 162A, 162B may be individually adjusted, for example, based on proximity measurements, or may be physically urged radially in response to engagement with the tubular wall. As a result, the tool 20 may record the variation in tubing wall with depth, to determine the non-linearity or other deviation, such as ovality, bending or buckling. If multiple pad stations are included (e.g., FIG. 2), then the radial variation may be obtained at more azimuthal locations for a more accurate or complete representation of how the tubing wall varies with depth. Additionally, directional information from additional sensors, such as from a triaxial gyroscope or accelerometer, may be used to measure tool tilt angle, which may be used to map the trajectory of the innermost tubular.

Figure 5:
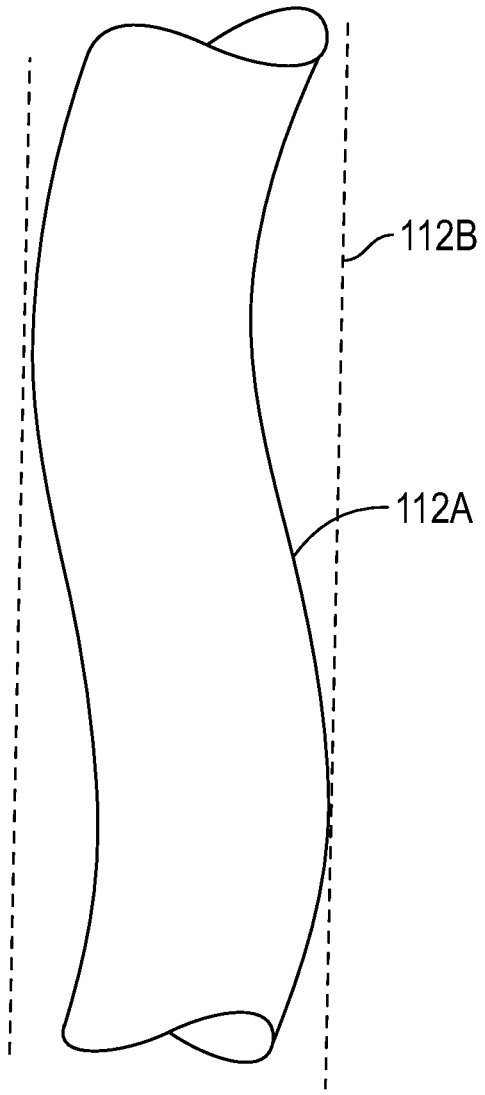
FIG. 5 is a schematic diagram of the non-linear tubular of FIG. 4 juxtaposed with an assumption of a straight outer tubing.

FIG. 5 is a schematic diagram of the non-linear tubular 112A of FIG. 4 juxtaposed with an assumption of a straight outer tubing. However, the simplified assumption of a straight outer tubing may also be flawed, having the same issues as the simplified tubing assumption of FIG. 3. A more accurate and useful method is needed for assessing the relationship between the first tubular and the second tubular disposed around the first tubular.

Figure 6:
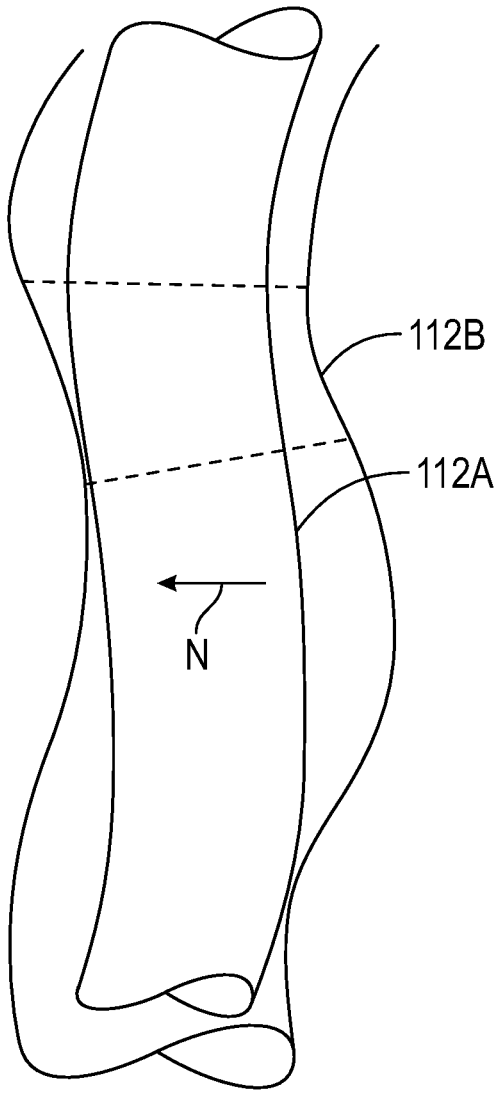
FIG. 6 is a schematic diagram of the tubular of FIG. 4 disposed within an outer tubular, wherein the straight outer tubing assumption is corrected based on information from sensors.

FIG. 6 is a schematic diagram of the non-linear tubular 112A of FIG. 4 (i.e., the inner tubular in this case) juxtaposed with an outer tubular 112B, wherein the straight outer tubing is corrected based on information from sensors. Baseline measurements are first obtained for the first tubular, such as PSEC measurements and curvature obtained per FIG. 4. Changes in the baseline of the sensor measurements may then be obtained as the tool travels through the portion of the inner tubular 112A that is overlapped by the outer tubular 112B. The changes in the baseline measurements are used, for example, to estimate the eccentricity of the inner tubular 112A with respect to the outer tubular 112B. The eccentricity may be characterized, for example, using an eccentricity ratio and eccentricity azimuth angle. These estimates, combined with the buckling profile of the inner tubular (FIG. 4), may be used to estimate one of the ovality, bending or buckling of the surrounding tubular.

Accordingly, the present disclosure provides a system, tool, and method for inspecting a tubular, which may be the nearest one of a plurality of nested tubulars, using PSEC sensors and optional gyroscopic or accelerometer information. The methods, systems, tools, and so forth may include any suitable combination of any of the various features disclosed herein, including but not limited to the following Statements.

Statement 1. A downhole tubular inspection tool, comprising: a tool body configured for lowering through a first downhole tubular on a conveyance; a plurality of sensor pads coupled to the tool body on extendable arms, the extendable arms movable to adjust a standoff between the sensor pads and the first downhole tubular; and a partial saturation eddy current (PSEC) sensor module including a magnetizer unit and one or more PSEC sensors arranged on the sensor pads, the magnetizer unit for generating a constant magnetic field to reduce a permeability of the first downhole tubular and the one or more PSEC sensors for inducing an eddy current in the first downhole tubular and responding to changes in the induced eddy current corresponding to a tubing wall variation of the first downhole tubular.

Statement 2. The downhole tubular inspection tool of Statement 1, further comprising: one or more directional sensors coupled to the tool body responsive to a directional orientation of the tool body as it is lowered through the first downhole tubular.

Statement 3. The downhole tubular inspection tool of Statement 2, wherein the plurality of sensor pads are circumferentially spaced about the tool body on the extendable arms and the extendable arms are movable to independently adjust the standoff between each sensor pad and the first downhole tubular.

Statement 4. The downhole tubular inspection tool of any of Statements 1 to 3, wherein the sensor pads and the extendable arms are arranged in at least first and second axial stations, wherein the PSEC sensors in the first axial station are in different axial and azimuthal positions than the PSEC sensors in the second axial station.

Statement 5. The downhole tubular inspection tool of any of Statements 1 to 4, wherein the extendable arms comprise at least one uplogging extendable arm extending upwardly from its sensor pad and at least one downlogging extendable arm extending downwardly from its sensor pad.

Statement 6. The downhole tubular inspection tool of any of Statements 1 to 5, further comprising: one or more proximity sensors coupled to the tool body responsive to the standoff of each sensor pad from the tubular wall; and a controller configured for independently adjusting an extension of the extendable arms to control the standoff of each sensor pad in response to the signal from the one or more proximity sensors.

Statement 7. The downhole tubular inspection tool of Statement 6, wherein the controller is further configured to: control the extensions of the extendable arms to maintain an equal standoff between the sensor pads and the first downhole tubular; and estimate one of the ovality, bending or buckling of the first downhole tubular based on the extensions required to maintain the equal standoff.

Statement 8. The downhole tubular inspection tool of Statement 6 or 7, wherein the first downhole tubular is nested in a second downhole tubular, wherein the controller is configured to obtain a baseline of sensor measurements when disposed in the first downhole tubular and to estimate an eccentricity of the first downhole tubular with respect to the second downhole tubular based on changes in the baseline of sensor measurements when moved into an overlapping portion between the first and second downhole tubulars.

Statement 9. The downhole tubular inspection tool of Statement 8, wherein the controller is configured to estimate an ovality, bending or buckling of the surrounding tubular based on the eccentricity.

Statement 10. The downhole tubular inspection tool of any of Statements 6 to 9 wherein the controller is configured to compensate sensor measurements based on the respective standoff.

Statement 11. The downhole tubular inspection tool of any of Statements 1 to 10, further comprising: a surface logging unit in communication with the PSEC sensor module and configured for one or both of displaying images of the tubular wall and dynamically adjusting one or more logging parameters in response to the sensed tubing wall variation of the first downhole tubular, wherein the one or more logging parameters comprise a logging speed, a repeat run, a power level, or a combination thereof.

Statement 12. The downhole tubular inspection tool of any of Statements 1 to 11, further comprising one or more non-ferromagnetic tubing centralizers for centering the tool body within the first downhole tubular.

Statement 13. A downhole tubular inspection method, comprising: lowering a logging tool through a first downhole tubular on a conveyance; generating a constant magnetic field to reduce a permeability of the first downhole tubular; inducing an eddy current in the first downhole tubular, wherein a penetration depth of the eddy current is increased by the reduced permeability; using one or more partial saturation eddy current (PSEC) sensors arranged on sensor pads to obtain sensor data responsive to changes in the induced eddy current corresponding to a tubing wall variation of the first downhole tubular; communicating the sensor data uphole through the conveyance; and one or both of displaying a real-time image representation of the well tubing and adjusting one or more logging parameter in real-time responsive to the sensor data.

Statement 14. The method of Statement 13, further comprising obtaining directional data using one or more directional sensors coupled to the tool body responsive to a directional orientation of the tool body as it is lowered through the first downhole tubular.

Statement 15. The method of Statement 13 or 14, wherein the representation of the tubing wall variation is representative of the tubing wall and orientation, wherein the directional data is selected from the group consisting of an eccentricity, a dip angle, an azimuthal angle.

Statement 16. The method of any of Statements 13 to 15, further comprising: dynamically controlling an extension of the extendable arms to control the standoff between the sensor pads and the first downhole tubular.

Statement 17. The method of Statement 16, further comprising: obtaining a baseline data based on measurements of the first downhole tubular; and using the baseline data to estimate the eccentricity of the first downhole tubular with respect to a second tubular disposed around the first downhole tubular.

Statement 18. The method of Statement 17, wherein the eccentricity is estimated as an eccentricity ratio and an eccentricity azimuth angle, and is used to estimate an ovality, a bending, or a buckling of the second downhole tubular.

Statement 19. The method of Statement 17, wherein the extension of pad arms is used to measure an ovality, a bending or a buckling of the first downhole tubular.

Statement 20. A downhole tubular inspection tool, comprising: a tool body configured for lowering through a first downhole tubular on a conveyance; a plurality of sensor pads coupled to the tool body on extendable arms, wherein the sensor pads and the extendable arms are arranged in at least first and second axial stations, wherein the PSEC sensors in the first axial station are in different axial and azimuthal positions than the PSEC sensors in the second axial station; one or more proximity sensors coupled to the tool body responsive to the standoff of each sensor pad from the tubular wall; a controller configured for independently adjusting an extension of the extendable arms to control a standoff of each sensor pad from the downhole tubular in response to the signal from the one or more proximity sensors; and a partial saturation eddy current (PSEC) sensor module including a magnetizer unit and one or more PSEC sensors arranged on the sensor pads, the magnetizer unit for generating a constant magnetic field to reduce a permeability of the first downhole tubular and the one or more PSEC sensors for inducing an eddy current in the first downhole tubular and responding to changes in the induced eddy current corresponding to a tubing wall variation of the first downhole tubular.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

The invention claimed is:

1. A downhole tubular inspection tool, comprising:

a tool body configured for lowering through a first downhole tubular on a conveyance;

an extendable arm coupled to the tool body;

a sensor pad, coupled to the extendable arm, wherein the extendable arm is configured to adjust a distance between the sensor pad and a tubing wall of the first downhole tubular; and a partial saturation eddy current (PSEC) sensor module coupled to the sensor pad, wherein the PSEC sensor module comprises:

a magnetizer unit configured to generate a constant magnetic field to reduce a permeability of the first downhole tubular; and a PSEC sensor configured to induce an eddy current in the first downhole tubular and respond to a change in the eddy current, wherein the change in the eddy current corresponds to a variation in the tubing wall.

2. The downhole tubular inspection tool of claim 1, further comprising:

a directional sensor coupled to the tool body, wherein the directional sensor is responsive to a directional orientation of the tool body as it is lowered through the first downhole tubular.

3. The downhole tubular inspection tool of claim 1, wherein the downhole tubular inspection tool further comprises:

a plurality of extendable arms comprising the extendable arm; and a plurality of sensor pads comprising the sensor pad, wherein the plurality of sensor pads are circumferentially spaced about the tool body on the extendable arms, and wherein the extendable arms are moveable to independently adjust a plurality of distances between the tubing wall and each of the plurality of sensor pads, respectively.

4. The downhole tubular inspection tool of claim 3, wherein the downhole tubular inspection tool further comprises:

a plurality of PSEC sensors comprising the PSEC sensor, on the plurality of sensor pads, respectively, wherein the plurality of sensor pads and the plurality of extendable arms are arranged in a first axial station and a second axial station, wherein the plurality of PSEC sensors in the first axial station are in different axial and azimuthal positions than the PSEC sensors in the second axial station.

5. The downhole tubular inspection tool of claim 1, wherein the extendable arm is an uplogging extendable arm that extends upwardly from the sensor pad, and wherein the downhole tubular inspection tool further comprises a downlogging extendable arm that extends downwardly from the sensor pad.

6. The downhole tubular inspection tool of claim 1, further comprising:

a proximity sensor coupled to the tool body, wherein the proximity sensor is responsive to the distance between the sensor pad and the tubing wall; and a controller configured to adjust an extension of the extendable arm to control the distance between the sensor pad and the tubing wall, in response to a signal from the proximity sensor.

7. The downhole tubular inspection tool of claim 6, wherein the downhole tubular inspection tool further comprises:

a plurality of extendable arms comprising the extendable arm; and a plurality of sensor pads comprising the sensor pad, coupled to the plurality of extendable arms, respectively, and wherein the controller is further configured to:

control extensions of the plurality of extendable arms to maintain a plurality of equal distances between the plurality of sensor pads and the tubing wall; and estimate one of an ovality, bending, or buckling of the first downhole tubular based on the extensions required to maintain the plurality of equal distances.

8. The downhole tubular inspection tool of claim 6, wherein the first downhole tubular is nested in a second downhole tubular, and wherein the controller is further configured to:

obtain a baseline of sensor measurements when disposed in the first downhole tubular;

obtain additional sensor measurements when disposed in an overlapping portion between the first downhole tubular and the second downhole tubular; and estimate an eccentricity of the first downhole tubular, with respect to the second downhole tubular, based on differences between the baseline of sensor measurements and the additional sensor measurements.

9. The downhole tubular inspection tool of claim 8, wherein the controller is further configured to:

estimate an ovality, bending, or buckling of the surrounding tubular based on the eccentricity.

10. The downhole tubular inspection tool of claim 6, wherein the controller is configured to compensate sensor measurements based on the distance between the sensor pad and the tubing wall.

11. The downhole tubular inspection tool of claim 1, further comprising:

a surface logging unit, in communication with the PSEC sensor module, configured to:

dynamically adjust a logging parameter in response to the variation in the tubing wall, wherein the logging parameter is a logging speed, a repeat run, or a power level.

12. The downhole tubular inspection tool of claim 1, further comprising a non-ferromagnetic tubing centralizer for centering the tool body within the first downhole tubular.

13. A downhole tubular inspection method, comprising:

lowering a logging tool through a first downhole tubular on a conveyance, wherein the logging tool comprises:

an extendable arm;

a magnetizer unit coupled to the extendable arm; and a partial saturation eddy current (PSEC) sensor coupled to the extendable arm; and using the logging tool to:

generate a constant magnetic field to reduce a permeability of the first downhole tubular, wherein the constant magnetic field is generated by the magnetizer unit;

induce an eddy current in the first downhole tubular, wherein a penetration depth of the eddy current is increased by a reduced permeability;

obtain sensor data responsive to changes in the eddy current corresponding to a variation in a tubing wall of the first downhole tubular, wherein the sensor data is obtained using the PSEC sensor;

communicate the sensor data uphole through the conveyance.

14. The method of claim 13, further using the logging tool to:

obtain directional data using a directional sensor coupled to the logging tool, wherein the directional sensor is responsive to a directional orientation of the logging tool as it is lowered through the first downhole tubular.

15. The method of claim 14, further comprising:

receiving an image representation of the tubing wall, wherein the image representation of the variation in the tubing wall is representative of the directional orientation, and wherein the directional data is selected from the group consisting of an eccentricity, a dip angle, and an azimuthal angle.

16. The method of claim 13, further comprising:

dynamically controlling an extension of the extendable arm to adjust a distance between the PSEC sensor and a tubular wall of the first downhole tubular.

17. The method of claim 16, further comprising:

using the logging tool to obtain a baseline data based on measurements of the first downhole tubular; and using the baseline data to estimate an eccentricity of the first downhole tubular with respect to a second downhole tubular disposed around the first downhole tubular.

18. The method of claim 17, wherein the eccentricity is estimated as an eccentricity ratio and an eccentricity azimuth angle, and wherein the eccentricity is used to estimate an ovality, a bending, or a buckling of the second downhole tubular.

19. The method of claim 17, wherein the extension of the extendable arm is used to measure an ovality, a bending, or a buckling of the first downhole tubular.

20. A downhole tubular inspection tool, comprising:

a tool body configured for lowering through a first downhole tubular on a conveyance;

a plurality of sensor pads coupled to the tool body on extendable arms, wherein the sensor pads and the extendable arms are arranged in at least first and second axial stations, wherein the PSEC sensors in the first axial station are in different axial and azimuthal positions than the PSEC sensors in the second axial station;

one or more proximity sensors coupled to the tool body responsive to the standoff of each sensor pad from the tubular wall;

a controller configured for independently adjusting an extension of the extendable arms to control a standoff of each sensor pad from the downhole tubular in response to the signal from the one or more proximity sensors; and a partial saturation eddy current (PSEC) sensor module including a magnetizer unit and one or more PSEC sensors arranged on the sensor pads, the magnetizer unit for generating a constant magnetic field to reduce a permeability of the first downhole tubular and the one or more PSEC sensors for inducing an eddy current in the first downhole tubular and responding to changes in the induced eddy current corresponding to a tubing wall variation of the first downhole tubular.

* * * * *